US005455610A

United States Patent [19]

Harrington

[11] Patent Number: 5,455,610

[45] Date of Patent: Oct. 3, 1995

[54] COLOR ARCHITECTURE FOPR AN INK JET PRINTER WITH OVERLAPPING ARRAYS OF EJECTORS

[75] Inventor: Steven J. Harrington, Holley, N.Y.

[73] Assignee: Xerox Corporation, Stamford, Conn.

[21] Appl. No.: 63,964

[22] Filed: May 19, 1993

[51] Int. Cl.[6] ..... B41J 2/15

[52] U.S. Cl. ..... 347/43

[58] Field of Search ..... 346/140 R, 75; 347/40, 43

[56] References Cited

U.S. PATENT DOCUMENTS

| | | | |
|---|---|---|---|
| 4,320,406 | 3/1982 | Heinzl | 346/140 R |
| 4,463,359 | 7/1984 | Ayata et al. | 346/140 R X |
| 4,750,009 | 6/1988 | Yoshimura | 346/140 R |
| 4,791,437 | 12/1988 | Accattino et al. | 346/140 R |
| 4,812,859 | 3/1989 | Chan et al. | 346/140 R |
| 4,855,752 | 8/1989 | Bergstedt | 346/1.1 |
| 4,899,178 | 2/1990 | Tellier | 346/140 R |
| 4,899,181 | 2/1990 | Hawkins et al. | 346/140 R |
| 4,967,203 | 10/1990 | Doan et al. | 346/1.1 |
| 5,030,971 | 7/1991 | Drake et al. | 346/140 R |
| 5,057,852 | 10/1991 | Formica et al. | 346/1.1 |
| 5,079,571 | 1/1992 | Eriksen | 346/140 R |
| 5,144,330 | 9/1992 | Bennett | 346/140 R X |

*Primary Examiner*—N. Le
*Attorney, Agent, or Firm*—Tallam I. Nguti

[57] ABSTRACT

A thermal ink-jet printer in which two parallel linear arrays of ejectors are disposed on a reciprocating carriage. The linear arrays are subdivided into sections, the ejectors in each section being adapted to emit ink of a preselected primary color. The linear arrays overlap to optimize a trade-off between speeds of monochrome and full-color operation.

15 Claims, 3 Drawing Sheets

COLOR ARCHITECTURE FOPR AN INK JET PRINTER WITH OVERLAPPING ARRAYS OF EJECTORS

BACKGROUND OF THE INVENTION

The present invention relates to ink-jet printing, and is more particularly concerned with color printing using a single printhead with overlapping linear arrays of ejectors to emit a plurality of different types of ink from various ejectors therein.

In existing thermal ink jet printing, the printhead typically comprises one or more ink ejectors, such as disclosed in U.S. Pat. No. 4,463,359, each ejector including a channel communicating with an ink supply chamber, or manifold, at one end and having an opening at the opposite end, referred to as a nozzle. A thermal energy generator, usually a resistor, is located in each of the channels, a predetermined distance from the nozzles. The resistors are individually addressed with a current pulse to momentarily vaporize the ink and form a bubble which expels an ink droplet. As the bubble grows, the ink rapidly bulges from the nozzle and is momentarily contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separation of the bulging ink as a droplet. The acceleration of the ink out of the nozzle while the bubble is growing provides the momentum and velocity of the droplet in a substantially straight line direction towards a print sheet, such as a piece of paper. Because the droplet of ink is emitted only when the resistor is actuated, this type of thermal ink-jet printing is known as "drop-on-demand" printing. Other types of ink-jet printing, such as continuous-stream or acoustic, are also known.

In a single-color ink jet printing apparatus, the printhead typically comprises a linear array of ejectors, and the printhead is moved relative to the surface of the print sheet, either by moving the print sheet relative to a stationary printhead, or vice-versa, or both. In some types of apparatus, a relatively small printhead reciprocates across a print sheet numerous times in swaths, much like a typewriter; alternatively, a printhead which extends the full width of the print sheet may be passed once down the print sheet to give full-page images, in what is known as a "full-width array" (FWA) printer. When the printhead and the print sheet are moved relative to each other, imagewise digital data is used to selectively activate the thermal energy generators in the printhead over time so that the desired image will be created on the print sheet.

As ink-jet products enter the market, they must respond to consumer demands for color printing, particularly when documents are prepared on personal computers. A common and expectable desired output for a color ink-jet printer would be a document such as a newsletter in which mainly black text will accompany a full-color image, such as a graph, which occupies only a portion of a sheet. There will thus be documents in which black-only (monochrome) and full-color modes may be in demand in the same job, and even on a single sheet. To optimize output speed of a color ink-jet printer, it may be desirable to provide a printer which can operate in two modes automatically as needed, a black-only mode and a full-color mode. It is to be presumed that the monochrome mode can print out faster than a full-color mode, because the monochrome mode will require only one "pass" of a printhead over a portion of a sheet, while the full-color mode requires a number of printheads, each printing one primary color, to pass over the same location of the sheet in the course of a job. However, if the printer is operable in two modes as required by the job, it makes sense that the monochrome mode not be unduly slowed down by the architecture of the system, which also must accommodate a full-color mode. Ideally, both the monochrome and full-color modes should operate at optimum speeds respectively.

It is therefore an object of the present invention to provide an architecture for a full-color thermal ink-jet printer, wherein a full-color mode may be optimally "traded off" with a maximum speed possible in a monochrome mode. Merely to place linear arrays of ejectors parallel to each other on a reciprocating carriage in an ink-jet printer has been found to be unsatisfactory from the aspect of print quality: if one ink is placed adjacent another ink on a sheet before the inks are substantially dried, a "muddy" appearance has been known to result as the liquid inks blend into each other on the sheet. Also, in a reciprocating-carriage printer, it has been shown that the hues of combined inks vary noticeably depending on the order in which the inks are placed on the sheet. Of course, in a case where four parallel printheads are each placed on the carriage, the order in which the inks are placed on the sheet will reverse depending on the direction of motion of the carriage; thus, such color printers having this feature are practically limited to printing in one direction only, which causes a serious limitation to be placed on the printer speed.

U.S. Pat. No. 4,812,859 discloses an ink-jet recording head wherein a plurality of nozzle groups are in communication with individual chambers, each chamber adapted to convey ink of one color. The head is retrofittable in a single-color printer to provide multicolor printing capability. The nozzle groups each duplicate a different longitudinal segment of the single color nozzle column pattern.

U.S. Pat. No. 4,855,752 discloses a method of creating an area of a preselected hue comprising a plurality of printed primary colors, in which the various flaws of primary colors are each offset by a predetermined amount, in order to minimize the visual "banding" effect when the boundaries between the swaths of different colors are coincident.

U.S. Pat. No. 4,967,203 discloses a method of producing a color image in an ink-jet printer wherein successive applications of ink dots are staggered relative to pixel locations such that overlapping ink dots are printed on successive passes of a printhead. Pixels are grouped into superpixels and various combinations of colored ink dots are applied to each pixel within each superpixel in a staggered sequence.

U.S. Pat. No. 5,030,971 discloses a "roofshooter" ink-jet printhead having a common heater substrate having at least two arrays of heating elements and a corresponding number of feed slots. Each nozzle array is isolated from an adjacent nozzle array and each nozzle is lined above a respective heating element of a corresponding heater array. With this construction, multi-color printheads are efficiently arranged on a single wafer.

U.S. Pat. No. 5,057,852 discloses an apparatus and method of producing enhanced four-color images with an ink-jet printer. True black ink is aligned for printing between cyan, magenta and yellow color spots in a full-color image. When a black edge is desired, process black (derived from a combination of primary colors) and the true black ink are both used to produce the pixels along the edge. The patent shows a printhead having nozzles for colored inks positioned in line with each other in the direction of travel of the printhead, with the black ink nozzle being disposed in separate lines.

SUMMARY OF THE INVENTION

According to the present invention, there is provided an ink-jet printhead for the ejection of ink in imagewise fashion onto a substrate. The printhead comprises a linear array of ejectors, adapted to selectively emit ink of a preselected type onto the substrate, in imagewise fashion according to input data. Means are provided for causing motion of the printhead relative to the substrate along a path. The printhead includes first and second linear arrays of ejectors for emitting ink onto the substrate, the linear arrays being arranged in fixed, parallel, and at least partially overlapping relation to each other and extending transverse to the path. One linear array comprises a first section having ejectors adapted to emit ink of a first preselected type and a second section having ejectors adapted to emit ink of a second preselected type.

In one embodiment of the invention, the two linear arrays of different resolutions. In another embodiment, the two linear arrays are each divided into two sections, and overlap by the length of one section. In yet another embodiment, the two linear arrays overlap by 4/5 of their lengths.

DESCRIPTION OF THE PREFERRED EMBODIMENTS

Figure 1:
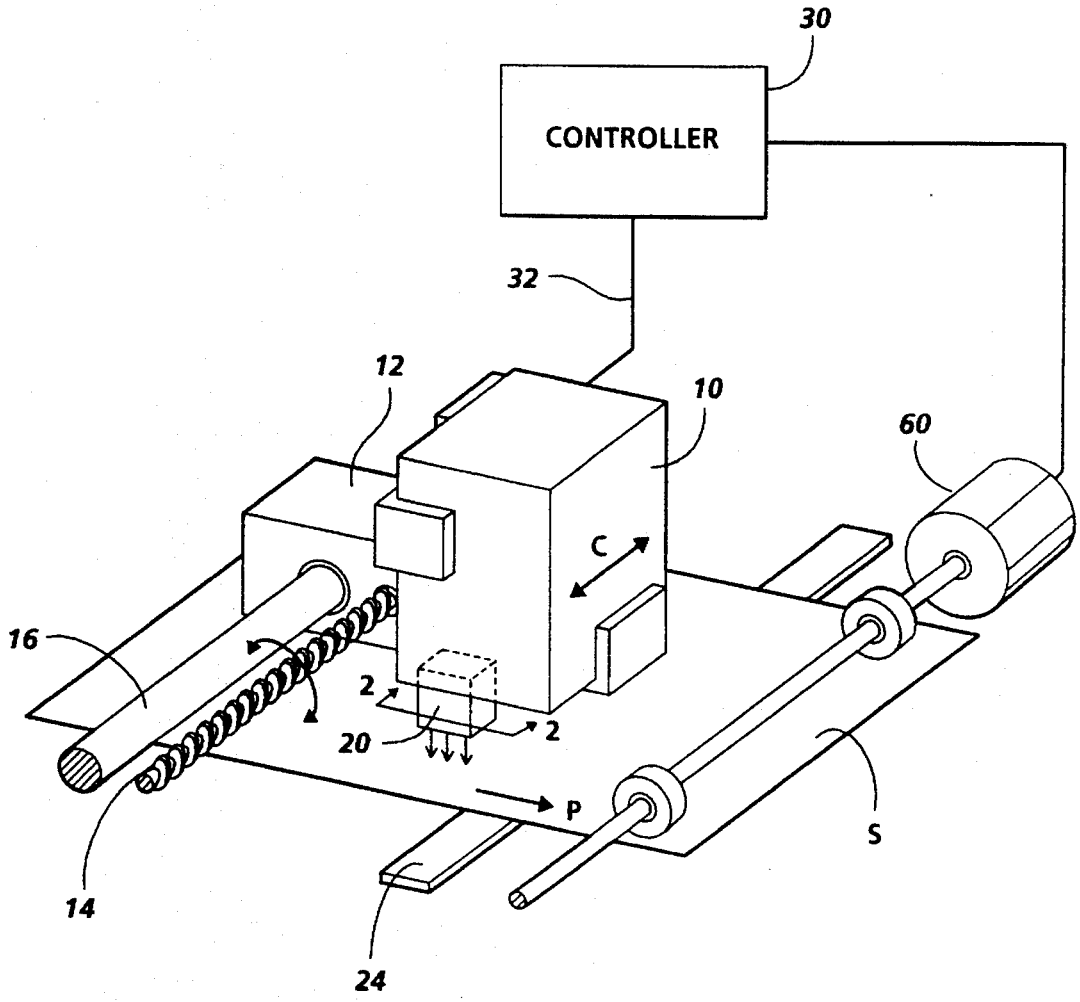
FIG. 1 is a perspective view showing the basic elements of a reciprocating-carriage-type thermal ink-jet printer, according to the present invention.

FIG. 1 shows the rudiments of a reciprocating-carriage-type thermal ink-jet printer for creating color or monochrome images on a sheet S. An ink cartridge 10, having a plurality of ink supplies therein, is preferably removably mounted on a carriage 12. This carriage 12 is adapted to move in a back-and-forth manner in direction C across sheet S, which is moving in process direction P. The sheet S is caused to move in direction P by means of a stepper motor or other indexing motor 60, which is preferably adapted to cause the motion of sheet S in direction P in a stepwise fashion, holding the sheet S in a stationary position while the cartridge 10 moves across the sheet in direction C, and then indexing the sheet S in processing direction P between swaths of printing caused by the action of cartridge 10 on carriage 12.

Carriage 12 is provided with one of various possible means for moving the cartridge 10 back and forth across sheet S. As shown in FIG. 1, there is provided a rotatable lead screw 14 having threads thereon which interact with a structure on the carriage 12 so that, when lead screw 14 is caused to rotate by a motor (not shown), the interaction of the lead screw threads with the structure on carriage 12 will cause the carriage 12 and the cartridge 10 mounted thereon to move in direction C across the sheet S. Preferably, in most embodiments of an ink-jet printer for use with the present invention, the behavior of the lead screw 14 should be such as to allow substantially even back-and-forth motion of the cartridge 10 so that the printing operation can be carried out in both directions. This may be accomplished, for example, by operatively attaching lead screw 14 to a bi-directional motor, or providing oppositely-wound sets of lead screw threads on lead screw 14 so that, once carriage 12 is moved to one side of the sheet S, the structure on carriage 12 will reengage with the opposite-wound threads on lead screw 14 to be moved in the opposite direction while the lead screw 14 is rotated in the same rotational direction. Further mechanical stability is provided for the motion of carriage 12 by, for example, a stabilizing rod 16 which passes through an opening in the carriage 12.

At the bottom of cartridge 10, as shown in FIG. 1, is a printhead 20, which is shown directed downward toward the sheet S. Printhead 20 comprises one or more linear arrays of thermal ink-jet ejectors, each ejector being operatively connected to a particular ink supply, in a manner which will be described in detail below, depending on the specific embodiment of the present invention. Generally, the linear array of ejectors in printhead 20 extends in a direction parallel to process direction P, so that, when the cartridge 10 is caused to move in carriage direction C, the linear array will "sweep" across the sheet S for an appreciable length, thus creating a print swath. While the carriage is moving across the sheet S, the various ejectors in the linear array are operated to emit controlled quantities of ink of preselected colors in an imagewise fashion, thus creating the desired image on the sheet. Typical resolution of the ink-jet ejectors in printhead 20 may be from 200 spots per inch to 800 spots per inch.

Also provided "downstream" of the printhead 20 along process direction P is drying means which are generally shown in FIG. 1 as a heating plate 24. The purpose of the drying means is to provide energy to ink which has just been placed on the sheet S, so that the ink will dry more quickly. Although a heating plate 24 is shown in FIG. 1, the drying means may include any number of devices for conveying heat or other energy to the ink placed on the sheet S. One particular drying means, for example, is a device for conveying microwave energy to the ink on the sheet, thereby dehydrating the sheet while limiting the extent of heat spread throughout the system, which may have an adverse effect on the operation of the printer as a whole. Other techniques for drying the ink in an efficient manner may also be contemplated such as providing a light flash, radiant or convective heat, or creating induction heat within a conductive member adjacent the sheet.

Operatively associated with the printhead 20 is a data input device, or controller, which is generally shown by a schematic box 30 connected by a bus 32 to the printhead 20. The purpose of the controller 30 is to coordinate the "firing" of the various ejectors in the printhead 20 with the motion of cartridge 10 in carriage direction C, and with the process direction P of sheet S, so that a desired image in accordance with the digital data is rendered in ink on the sheet S. Image data in digital form is entered into controller 30, and controller 30 coordinates the position of the printhead 20 relative to a sheet S, to activate the various ejectors as needed, in a manner generally familiar to one skilled in the art of ink-jet printing. Controller 30 will also be operatively associated with the various motors such as 60, controlling the position of sheet S through process direction P, and also the motion of the carriage 12, through means not shown.

Figure 5:
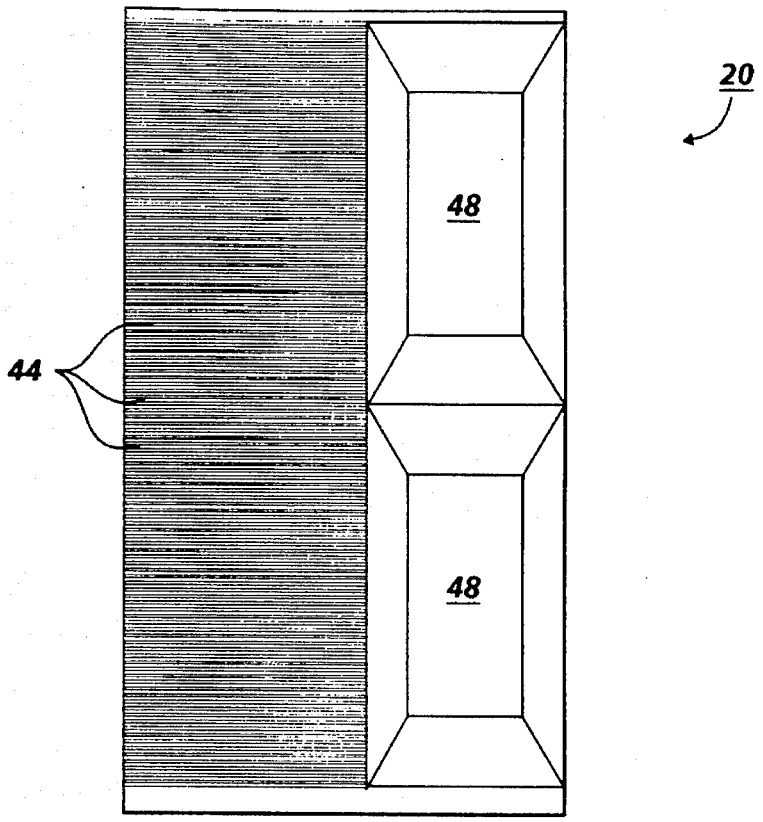
FIG. 5 is a partial sectional view showing a portion of one chip forming the printhead in the printer of FIG. 1.
Figure 6:
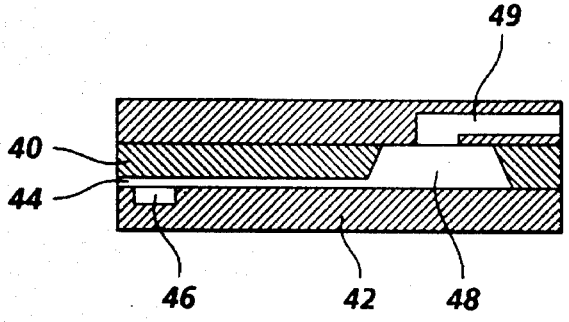
FIG. 6 is a sectional, elevational view of a representative ejector in the printhead.

FIG. 5 and 6 show portions of a linear array as used in printhead 20 in greater detail. FIG. 5 is a partial-sectional view showing a possible configuration of nozzles in one array of printhead 20. The process direction of the sheet relative to the printhead is given by P, and the direction of the carriage C is orthogonal to the page. In the embodiment shown, there is provided in each linear array in the printhead 20 about 120 ejectors. These ejectors are formed from a printhead of one of any designs for a linear-array thermal ink-jet printhead known in the art, such as in, for example, U.S. Pat. Nos. 4,899,178 or 4,899,181, both assigned to the assignee of the present application, and adapted for use in a multi-color context wherein inks of different colors, from different manifolds within the printhead chip, are assigned to specific subsets of ejectors in the printhead, as will be described in detail below. In the embodiment shown, the preferred resolution of the ejectors is 300 ejectors per inch, resulting in a linear array of approximately 1 centimeter in length; currently coming into common use, however, are ink-jet systems having resolutions of 360, 400, or 600 ejectors per inch.

FIG. 6 is a sectional elevational view of a single ejector of several in a linear array of ink-jet ejectors in printhead 20. (The linear array, in this view, extends into the page.) The printhead in general, according to the illustrated "side-shooter" design, comprises two key parts, a "channel plate" 40 and a "heater plate" 42. Preferably, each of these plates 40 and 42 is made of a single piece of silicon for the entire printhead 20. The channel plate 40 and the heater plate 42 are abutted together to form the linear array of ejectors between them. The channel plate 40 has defined therein on the face thereof facing the heater plate 42, a plurality of channels which form the nozzles for the ejectors, one of which is shown as 44. Adjacent each channel 44 in the channel plate 40 is a heating element 46. Each heating element 46 is operatively connected by circuit means (not shown) to a controller such as 30, which provides electrical power to the heating element when it is desired to "fire" the particular ejector. Each heating element 46 includes an effective surface which becomes hot when electricity is applied to heating element 46, and this effective surface is exposed to the void formed by the adjacent channel 44. In a typical preferred design, the heating element 46 is itself disposed in a slight pit adjacent channel 44, as shown, in order to improve the general performance of the printhead. Each channel 44 is in communication with an ink supply manifold 48. Preferably, a plurality of channels 44 in a contiguous subset are operatively connected to one ink supply manifold 48, which functions as a common ink supply for all of the ejectors connected thereto. Both the channels 44 and the ink supply manifolds 48 are created as voids within a single silicon channel plate 40 by known etching techniques. The ink supply manifold 48 is in turn accessed to a larger supply of ink through a tube such as 49, or any other means which will be apparent to one skilled in the art. In the embodiment shown, the tube 49 is formed as a void in a further member adjacent to the channel plate 40; generally speaking, however, the precision of the tube 49 into ink supply manifold 48 need not be as precise as the formation of the channels 44, and therefore tube 49 may be defined in an inexpensive material such as plastic.

Briefly, a side-shooter printhead, as illustrated in FIG. 6, works as follows. Ink of a preselected type is introduced through tube 49 into manifold 48 and is then conducted into a plurality of channels such as 44. When in the course of printing a document, a pixel corresponding to a particular channel 44 is to be printed upon, a signal is sent by the control means to the corresponding heating element 46, and the energy of the signal causes heat to be generated in the channel 44. The heat causes the vaporization of ink in the channel 44, and liquid ink in the channel 44 is pushed out in the form of a droplet toward the sheet. Once a quantity of liquid ink is ejected from the channel 44, the channel 44 is replenished from ink manifold 48.

Returning to FIG. 5, it can be seen that there is provided in a unitary chip (i.e. not two separate chips abutted side-by-side) forming one linear array of ejectors having a plurality (here, two) of ink supply manifolds 48, with the two manifolds each supplying liquid ink to one section of channels 44 within the linear array. Such a configuration, or a variation thereof, will be apparent in the various embodiments of the present invention described in detail below. In the ink-jet printer according to the present invention, there are provided two such linear arrays as shown in FIG. 5, each preferably but not necessarily formed from unitary silicon chips.

Figure 2:
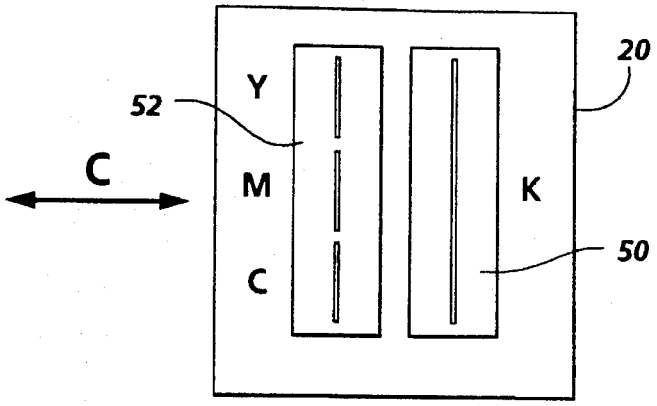
FIG. 2 is a plan view of a printhead according to one embodiment of the present invention.
Figure 3:
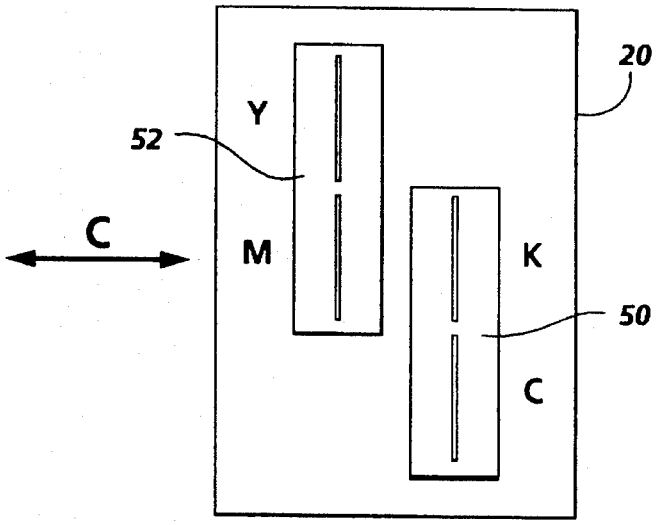
FIG. 3 is a plan view of a printhead according to another embodiment of the present invention.
Figure 4:
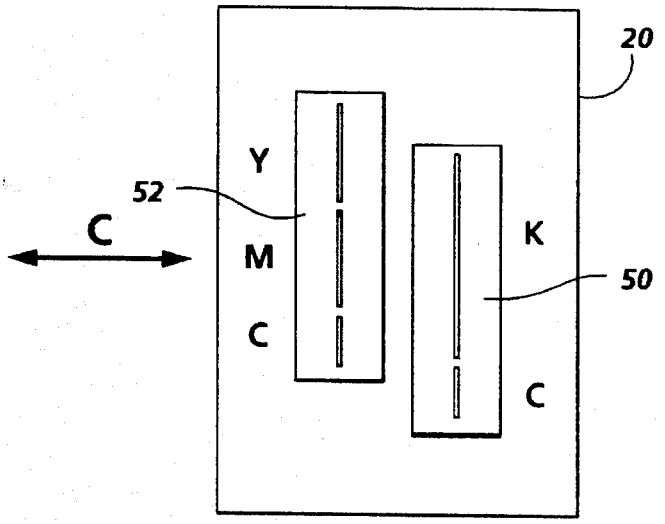
FIG. 4 is a plan view of a printhead according to another embodiment of the present invention.

FIGS. 2, 3, and 4, are plan views, respectively, looking "upward" from the surface of the sheet S, of printhead configurations according to various embodiments of the present invention. In each case, there is shown linear arrays of ejectors, various ejectors being adapted to emit ink of a particular preselected color, such as black (shown as k), yellow (y), magenta (m), or cyan (c). As can be seen in each Figure, the ejectors are arranged in two linear arrays, shown generally as 50 and 52 are arranged transverse to the carriage direction C through which the printhead 20 moves in swaths across the sheet S in a reciprocating-printhead printer. It will be noted that, in comparing FIGS. 2–4 with FIG. 1, that the printhead 20 may move in either direction along carriage path C with neither linear array 50, 52 having to be "first" along the path of carriage motion.

In each embodiment of the FIGS. 2–4, one or more of the linear arrays 50, 52 is subdivided into two or more sections, in which a subset of ejectors within a given section is dedicated to emitting ink of one preselected primary color. Although the subdivided sections within each linear array 50 or 52 are shown spaced by a gap, it may be preferred that the sections of ejectors emitting different color inks abut each other with no gap in the linear array.

FIG. 2 shows a printhead according to one embodiment of the invention. In this embodiment, there are two linear arrays of equal length, which are disposed in fixed parallel relationship with each other and overlap for their entire length. As can be seen in FIG. 2, one of the linear arrays 50 is adapted for its entire length to emit black ink. The other linear array 52 is subdivided into three equal sections, each section dedicated to emitting ink of one primary color, yellow, magenta, or cyan. Because, in a reciprocating-printhead ink-jet printer, the printer prints in a series of swaths across the sheet S, the width of the swath will be the effective width of the linear arrays 50, 52. The wider the swaths, the fewer passes must be made by the cartridge 10 and carriage 12 across the sheet S in the course of printing out an entire sheet. Thus, with the printhead of FIG. 2, when the printhead 20 is moved through direction C in either direction to print a black-only image, the entire length of the linear array 50 can be activated, and the swath width will be the full width of the linear array 50. Because the linear array 50 is relatively wide, printing a black-only image is relatively rapid because fewer swaths are required. However, if it is desired to print a full-color image using the primary-color inks from the sections of linear array 52, the maximum swath width, and therefore the maximum operating speed, of the printer is restricted by the width of an individual primary color section within linear array 52. In other words, each section of primary-color ejectors within linear array 52 must "cover" the entire area of a sheet S. Because the width of each section in linear array 52 is one-third that of the all black linear array 50, it follows that three times as many swaths are needed to cover a sheet S, and following each swath, the sheet S must be indexed in process direction P only the distance of the width of one section within linear array 52. Therefore, comparing maximum possible process speeds of an ink-jet printer between printing a black only image or portion of an image, and a full-color image or portion of an image, the all-black image may be printed at three times the speed of a full-color image, because the effective swath is three times wider.

According to the FIG. 2 embodiment of the present invention, the black-printing ejectors are provided with a higher resolution (that is, higher number of ejectors per inch) than that of the color ejectors, for example, 600 spots per inch versus 300 spots per inch. In full-color printing, the entire length of the array 50 is used in each swath, but each ejector prints only every third pixel of the scan line, or, more generally, only one sequentially-determined subset of pixels in the scan line. For example, the 1st, 4th, 7th, . . . ejectors of the array would each print the 1st, 4th, 7th, . . . pixels of their respective scan lines. Likewise the 2nd, 5th, 8th, . . . ejectors would each print the 2nd, 5th, 8th, . . . pixels and the 3rd, 6th, 9th, . . . ejectors would each print the 3rd, 6th, 9th, . . . pixels. (As used in the claims herein, the first-numbered pixel in each of these sequences shall be known as a "reference" pixel, and will thus determine the "phase" of which subset of pixels will be activated. Also, as used herein, a given ejector is "activated" when it is capable of printing a spot on the substrate at a given time; whether a spot is actually printed at a given time will, of course, be further dependent on the nature of the image being printed.)

The phases of which sequentially-determined subset of ejectors is activated must be assigned such that when sheet S is indexed by the width of one section of array 52, the pixels printed on a scan line are different from any previously printed. The distribution of the pixels being printed by the first linear array should vary with the position of the array so that all phases are equally represented. For example a scan line might first have its 3rd, 6th, 9th, . . . pixels printed. After indexing, a different ejector will again pass over the scan line printing the 2nd, 5th, 8th, . . . pixels. One more index of sheet S brings the scan line under a third ejector which completes it by printing the 1st, 4th, 7th, . . . pixels. When printing a full-color image, the length of the indexing of sheet S after each swath is made across the sheet is limited to the width of one section of array 52, and therefore three times as many passes of the printhead 20 are needed. Because the indexing length is one-third that of the entire width of the black array 50, one portion of the length of array 50 will "cover" all of the sheet three times.

Because the linear array 50 includes ejectors of a relatively high resolution, the black areas such as text in the image can be printed with higher quality, particularly along the edges thereof. The triple-passing of the high-resolution array 50 enables a high-precision method of printing to be carried out: with each pass, a screen of every third black pixel is printed, and the time between successive passes gives the laid-down black ink some time to dry before the laying down of neighboring black pixels. Further, although high-resolution ejectors necessarily must print out at higher rate to "cover" a given length on the sheet, the triple-passing of the black pixels will more than alleviate the necessity for higher data rates to the fine-resolution ejectors: while the necessary rate of firing for a 600 spi ejector will be twice that of a 300 spi, the fact that an individual ejector in array 50 will fire only once every threepixels, means the actual data rate to an individual ejector will only be ⅓ of this necessary rate. Further, the superposition of neighboring pixels will lessen the concpicuousness of "printhead signatures," that is, artifacts on the printed document caused by failures of single ejectors repeating across each swath.

FIG. 3 shows another embodiment of a printhead according to the present invention, in which both arrays 50, 52 are divided into two subsections. As can be seen in FIG. 3, the linear arrays 50, 52 are in fixed parallel relation to each other, but overlap only by the width of one section each, so that the total width of the overlapping linear arrays is 50 percent more than that of a single linear array. It will also be noted that the black section (k) of linear array 50 corresponds exactly with the magenta section (m) of linear array 52. In this embodiment, all of the sections of the arrays may be of the same resolution.

When the printhead 20 of FIG. 3 is caused to move through carriage path C in either direction thereof, three swaths are laid down on the sheet S: from the top of the Figure, a yellow swath, a combination magenta and black swath, and then a cyan swath. Each swath is of a width one-half that of either linear array 50, 52. It will be seen that in comparing the printhead of FIG. 3 with the printhead of FIG. 2, the swath in the full-color mode may be significantly wider with the printhead of FIG. 3, and therefore, all other parameters being equal, the printhead of FIG. 3 is capable of printing slightly faster in full color (50% faster, comparing the relative widths of the color sections) than the printhead of FIG. 2. However, the trade-off comes if it is desired to print a black-only image: as can be seen, the black section of array 50 in FIG. 3 is precisely one-half that of the black section in array 50 in FIG. 2, and therefore twice as many swaths will be needed to cover a sheet with the printhead of FIG. 3 in a black-only image. However, if it is known that the user of the printer is likely to print many documents having a mixture of black-only sections and full-color sections along the process direction P, there may be an optimum trade-off in lessening the black-only speed relative to the full-color speed.

FIG. 4 shows a printhead 20 according to another embodiment of the present invention. In this embodiment, the linear arrays 50, 52 are disposed in fixed parallel relation to each other, but overlap by ⅘ of the lengths thereof. As can be seen in FIG. 4, the ⅘ of linear array 50 which overlaps linear array 52 is dedicated entirely to the emission of black ink. At the same time, the ejectors in linear array 52 are subdivided so that, from the top of the Figure, ⅖ emits yellow ink, the next ⅖ emits magenta ink, and the final ⅕ emits cyan ink. However, the cyan ⅕ of linear array 52 is in effect "continued" by the bottom ⅕ of linear array 50, so that the cyan swath formed when printhead 20 is moved through path C is half created by ejectors in linear array 52 and half created by ejectors in linear array 50. When the printhead is printing a full-color image, three adjacent swaths will be placed on sheet S: a yellow swath, a combination magenta and black swath, and a cyan swath, each swath having the width of ⅖ of an entire linear array. In one configuration, when a full-color image is being printed, only those ejectors in the black section which match with ejectors in the magenta section will be operated, so as to avoid any interaction with yellow ink being simultaneously emitted onto the sheet.

Alternatively, when a full-color image is being printed, one can use all of the ejectors across the black section, but in each swath having each ejector print only every other pixel, thus making a checkerboard pattern. Half the ejectors in the black section (e.g. those corresponding to the magenta section) would print the pixels making the checkerboard pattern, while the remaining black ejectors would print the remaining black pixels. This scheme would be effective in reducting the visual effect of head signature in half-tone areas.

The advantage of the arrangement of ejectors in FIG. 4 is that, as can be seen, a full-black swath is of a width that is ⅘ of an entire linear array, while the three swaths of a full-color array are each ⅖ of a linear array; that is, there is a 2:1 ratio in swath width, and therefore speed, between the black and color portions in this embodiment. Because of this relatively close ratio of speeds between black-only and full-color printing, 2:1 instead of 3:1, as in the embodiments of FIG. 2, a closer trade-off between operating at the two different speeds may be made when, for example, printing a document having all-black portions along process direction P and also full-color portions.

It will be noted that in all of the above embodiments of the present invention, the order of laying down primary color inks on the sheet S will be the same no matter which direction the carriage is moving through path C. This feature is important, since it has been found that, in full-color images, the hues may be slightly different depending on the specific order in which the primary color inks are placed on the sheet.

It will also be noted that the order of colored inks within the print head is not restricted to the order of the illustrated embodiments, but rather, any permutation of the three colored inks may be used.

Although the illustrated embodiments show two linear arrays mounted on the same cartridge 10, it is conceivable that the two linear arrays could be part of separate ink supply cartridges, and held in fixed relation to each other by structure on carriage 12 or on the cartridges themselves. In the FIG. 2 embodiment, for example, it is a possible scenario that the ink supply to the all-black array will be exhausted at a substantially different time than the ink supply for the primary-color linear array. In such a case, it may be an advantageous design configuration to have the two linear arrays mounted on separate ink supply cartridges, so that one cartridge or the other could be replaced as needed. However, providing separate cartridges could cause significant problems of ensuring precise registration between the two linear arrays.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. An ink-jet printer for emitting ink onto a substrate, comprising:

a printhead for selectively emitting ink of a preselected type onto the substrate; and means for moving the printhead relative to the substrate along a path;

the printhead including first and second linear arrays of ejectors for emitting ink onto the substrate, the linear arrays being arranged in fixed, parallel, and at least partially overlapping relation to each other and extending transverse to the path, wherein the first linear array has a higher number of ejectors per inch than the second linear array, and wherein the second linear array comprises a first section having ejectors for emitting ink of a first preselected type and a second section having ejectors for emitting ink of a second preselected type.

2. A printer as in claim 1, wherein the ink of the first preselected type and the ink of the second preselected type are of different colors.

3. A printer as in claim 2, wherein the first linear array of ejectors comprises one section emitting ink of a preselected color throughout a length thereof, and the second linear array of ejectors comprises a plurality of sections along the length thereof, each section having ejectors emitting ink of a different preselected color.

4. A printer as in claim 3, wherein the first linear array of ejectors emits black ink throughout the length of said one section, and the second linear array of ejectors comprises said plurality of sections along the length thereof, each of said plurality of sections having ejectors emitting ink of a different preselected color.

5. A printer as in claim 4, wherein the second linear array of ejectors comprises three sections along the length thereof, each section having ejectors emitting ink of a subtractive primary color.

6. A printer as in claim 3, wherein the first linear array of ejectors completely overlaps the second linear array of ejectors.

7. A printer as in claim 3, further comprising means for selectably indexing the substrate relative to the printhead in a direction transverse to the path by a distance equal to the length of the first linear array plus a length of a section of the second linear array.

8. A printer as in claim 3, further comprising a control system for activating only a subset of the ejectors in the first linear array as the printhead moves through the path in a single swath, the subset of ejectors activated being every x-th ejector across the first linear array starting from a reference ejector, x being an integer.

9. A printer as in claim 8, wherein x is equal to the number of sections in the second linear array.

10. A printer as in claim 3, further comprising a control system for activating each ejector in the first linear array for a sequentially-determined subset of pixels including every y-th pixel starting from a reference pixel as the printhead moves through the path in a single swath, y being an integer.

11. A printer as in claim 10, wherein y is equal to the number of sections in the second linear array.

12. A printer as in claim 10, further comprising means for indexing the substrate at a step length that is an integral multiple of a length of a section of said second linear array of ejectors.

13. A printer as in claim 12, wherein the reference pixel for the sequentially-determined subset of pixels printed by each ejector is variable with successive swaths.

14. A printer as in claim 1, further comprising means for indexing the substrate at a step length that is an integral multiple of a length of one of said first section and said second section of said second linear array.

15. A printer as in claim 14, wherein the first linear array of ejectors and the second linear array of ejectors are equal in length, and overlap by a length equal to ⅘ of that of the arrays.

* * * * *

UNITED STATES PATENT AND TRADEMARK OFFICE

CERTIFICATE OF CORRECTION

PATENT NO. : 5,455,610

DATED : October 3, 1995

INVENTOR(S) : Steven J. Harrington

It is certified that error appears in the above-indentified patent and that said Letters Patent is hereby corrected as shown below:

On the title page: Item [54] and Column 1,line 1, delete "FOPR" -- and insert -- FOR --.

Signed and Sealed this

Thirteenth Day of February, 1996

*Attest:*

Bruce Lehman

BRUCE LEHMAN

*Attesting Officer*

*Commissioner of Patents and Trademarks*